US006758432B1

(12) United States Patent
Rufo

(10) Patent No.: US 6,758,432 B1
(45) Date of Patent: Jul. 6, 2004

(54) PAPER FEEDING DEVICE, IN PARTICULAR FOR CARDBOARD PRODUCTION LINE

(76) Inventor: Donato Rufo, 37, rue Jules Macbard, 39100 Dole (FR)

( * ) Notice: Subject to any disclaimer, the term of this patent is extended or adjusted under 35 U.S.C. 154(b) by 0 days.

(21) Appl. No.: 09/979,866

(22) PCT Filed: May 29, 2000

(86) PCT No.: PCT/FR00/01453

§ 371 (c)(1),
(2), (4) Date: Feb. 19, 2002

(87) PCT Pub. No.: WO00/73184

PCT Pub. Date: Dec. 7, 2000

(30) Foreign Application Priority Data

Jun. 1, 1999 (FR) ..... 99 07041

(51) Int. Cl.[7] ..... B65H 19/18; B65H 21/00; B65H 69/06

(52) U.S. Cl. ..... 242/555.4; 242/559.4

(58) Field of Search ..... 242/555.4, 559.4, 242/559

(56) References Cited

U.S. PATENT DOCUMENTS

| | | | | |
|---|---|---|---|---|
| 3,948,715 A | | 4/1976 | Tokuno | 156/351 |
| 4,009,841 A | * | 3/1977 | Matalia | 242/555.4 |
| 4,089,482 A | * | 5/1978 | Mooney et al. | |
| 4,518,127 A | * | 5/1985 | Hurst | 242/555.4 |
| 4,763,851 A | * | 8/1988 | Flament | |
| 4,967,974 A | * | 11/1990 | Kawamura | 242/559.4 |
| 5,562,038 A | * | 10/1996 | Bierbaum et al. | |

FOREIGN PATENT DOCUMENTS

| | | | |
|---|---|---|---|
| DE | 1281766 B | * | 12/1964 |
| FR | 2230571 A | * | 12/1974 |
| FR | 2587982 A | * | 4/1987 |
| JP | 60061449 A | * | 4/1985 |

* cited by examiner

*Primary Examiner*—John M. Jillions
(74) *Attorney, Agent, or Firm*—Davis & Bujold, PLLC

(57) ABSTRACT

The present invention concerns a compact, simple, and economical supply device providing high speed splicing with no operator intervention, as well as automatic spool loading and unloading. The paper supply device (1) comprises two winders (2, 3) each supporting a spool of paper (4, 5), the first of which is a working spool and the second, a reserve spool, and a mechanism (6) for automatically splicing the end of the strip on the working spool with the beginning of the strip on the reserve spool. It is characterized in that the automatic splicing device (6) is located between the two winders (2, 3) and comprises two diversion rollers (60, 61) which rotate freely on at least one common plate (62), the plate rotating on a axle affixed to a trolley (63) so as to alternately place the diversion rollers (60, 61) in a first connection position and then in a second connection position, corresponding respectively to the working spool, with the trolley (63) being movable in translation from one spool to the other.

18 Claims, 4 Drawing Sheets

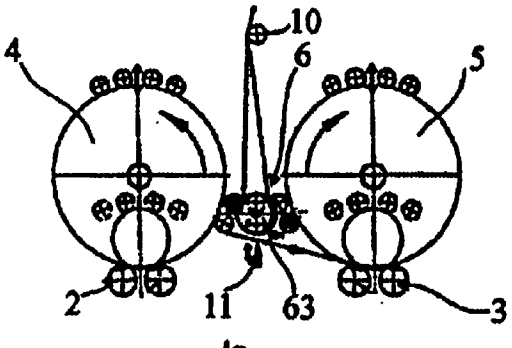
FIG. 6
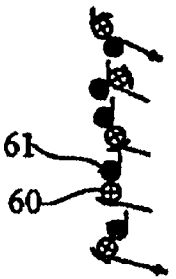
FIG. 6E
FIG. 6F
FIG. 6G
FIG. 6H
FIG. 6A
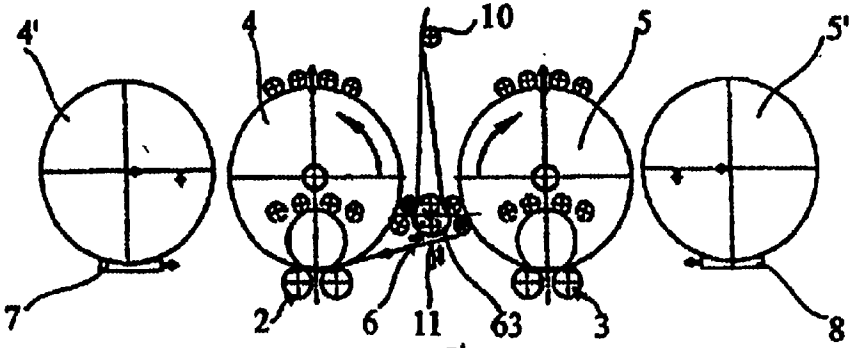
FIG. 5
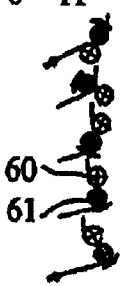
FIG. 5A
FIG. 5B
FIG. 5C
FIG. 5D
FIG. 5E
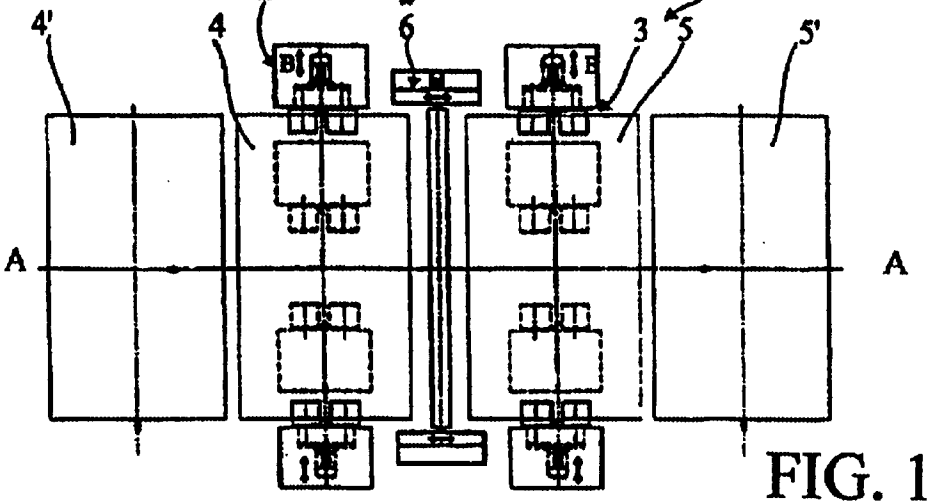
FIG. 1

6
60
61
62
63
64
65
66
67
68
69
70
71
72
73
74
75
76
77
D
E
E

PAPER FEEDING DEVICE, IN PARTICULAR FOR CARDBOARD PRODUCTION LINE

FIELD OF THE INVENTION

The instant invention concerns a paper supply device, specifically for use in a cardboard manufacturing production line, said device comprising two parallel winders, one behind the other, each supporting a spool of paper, the first spool being a working spool and the second a reserve spool, said winders being alternately activated to ensure a continuous supply of paper to the production line, said device also comprising a drive means for the feed mechanisms, a means for detecting the end of the strip on the working spool, and a means for automatically attaching the end of the strip on the working spool to the beginning of the strip on the reserve spool.

BACKGROUND OF THE INVENTION

In the cardboard manufacturing industry such paper supply devices are well known. They usually consist of two winders, each in the form of a support with two arms holding the spool of paper, which is emptied when the production line drive rollers exert a pull on the spool of paper. When the working spool, which is rotating, is joined to the reserve spool, which is stopped, either the production line slows down due to the resistance resulting from the new full spool starting up, or else the roll of paper yields to the pull exerted. This affects both the output of the production line and the quality of cardboard produced.

In order to connect the end of the working spool strip with the beginning of the reserve spool strip, a specific assembly device that is separate from the supply mechanism is usually used, currently known as a "splicer." An operator is required to intervene when the rolls are joined in order to prepare the connection, properly position the beginning of the strip in relation to the end of the strip, and ensure that they are correctly spliced. Thus, splicing cannot take place automatically; an operator is required. The "splicer," usually located overhead, is a heavy, expensive piece of equipment. Furthermore, when either the type of paper or paper width must be changed, manual intervention is required for splicing and repositioning the arms of the winders, etc. Since it is not possible to intervene instantly, the operator is obliged to slow the production line down, decreasing output.

Moreover, in order to remove an empty spool and replace it with a full one, the arms must be lowered, separated, and then closed. This intervention takes five minutes of an operator's time. Although the spools can be loaded and unloaded automatically, this takes a long time. Furthermore, the empty or full spools are manipulated by conventional trolleys equipped with a means for gripping the spools.

Certain semi-automatic or automatic splicing devices which exist in the art are described in the following publications. In Publication DE-B-12 81 766, the assembly device comprises two parallel loose rollers, arranged between the two spools at the top portion and attached to a support which pivots on the axle of the third loose roller located at the lower portion, placing the first roller in contact with the reserve spool in order to connect the end of the working spool strip with the beginning of the reserve spool strip. The first two rollers are attached to a turning plate which pivots 180° and has a handle for manipulation. Thus, the system is very complex, expensive, and does not function entirely automatically, since an operator must intervene to tilt the rollers 180° and complete the connection to the other spool.

In publication FR-A-230 571, the assembly device consists of a trolley supporting two diversion rollers, said trolley moving along a ramp above the spools, and said ramp alternately tilting from one spool to the other in order for the strips to be spliced. This device is complex, costly, and clumsy. Furthermore, starting up the winder according to this method is difficult, as it requires that a strip be introduced into the upper diversion rollers.

Finally, in Publication F.R.-A-2 587 982, the splicing device described is for use with superimposed spools. It comprises a movable trolley located beside the spools, holding a support with three diversion rollers between which the strip passes. Once connected, the support pivots about the central roller between two end positions that are angularly offset by approximately 90° in order to place one or the other diversion rollers in contact with the waiting spool. Three cylinders are used to pivot said support, one advance cylinder and two contact cylinders. Thus, the device is relatively complex to use, guide, and adjust. The fact that the spools are superimposed complicates the loading and unloading process; these operations are difficult to automate because the manipulations must be performed overhead.

The goal of the present invention is to overcome these disadvantages by proposing a supply device that is simple to use, requires a minimal investment and only a small amount of space, and offers high speed, automatic splicing with no operator intervention, as well as automatic spool loading and unloading. The essential aim of the invention is to significantly reduce the time required to prepare and change spools while at the same time offering a means for splicing the spools at very high speed with no risk to the paper or to the production line.

This goal is achieved by the supply device as described in the preamble, characterized in that the automatic splicing means is located between the two winders, parallel to them, and comprises two diversion rollers that are parallel and separated by a predetermined fixed interval, said diversion rollers extending at least along the entire width of the paper on said spools and receiving the strip of paper corresponding to the working spool, and said two diversion rollers rotating freely on at least one common plate and being driven to rotate on their axles by the strip of paper as it unfurls, while the plate itself rotates at a fixed angle on a trolley so that it alternately places the diversion rollers in a first connected position and then in a second connected position, respectively, corresponding to the working spool, with said trolley moving in translation perpendicular to the axis of the spools so as to place one of the diversion rollers in contact with the working spool in said connected positions. Said splicing device also comprises a means for driving said plate and a means for driving said trolley.

SUMMARY OF THE INVENTION

In a preferred form of the invention, the means for driving said plate comprises at least one motor and one mechanical transmission between the drive shaft and the plate to alternately turn the plate at an angle smaller than 360°, with the limits of this angle corresponding to the two connection positions for said diversion rollers, said angle ranging from 250° to 290° and preferably being equal to 270°.

The automatic splicing means may consist of at least two parallel rails attached to the floor perpendicular to said spools with the rails being separated by a distance which is at least equal to the span of the spools, and each rail being equipped with a rack. The trolley may have at least one motorized beam extending between the two rails, equipped at each end with a pinion engaging the rack of the corresponding rail, and the drive means for the movable trolley may comprise at least one motor and one mechanical transmission connected to said motorized beam.

Each winder advantageously comprises at least one chassis attached to the floor, one platform attached to said chassis, and two pairs of drive rollers parallel to the spool axis, said two pairs being aligned and designed to support the roll of paper; the drive means for the winder comprises a motor and a mechanical transmission between the drive shaft and one of the drive rollers, with the other drive rollers being driven by the rotating spool.

In the preferred form of the embodiment, each winder comprises two platforms, each supporting a pair of drive rollers, said two platforms moving in translation symmetrically in relation to the median axle A of said device, said median axle being perpendicular to the axis of the spools, in order to adjust the interval between the two pairs of rollers to the width of said spool.

The chassis of each winder may comprise two sections that are parallel to each other and to the spool axis, at least one section supporting the rack, and the platforms may comprise at least two slides which slide along or inside said sections and at least one motor, which is a stepping motor, driving a pinion that engages said rack.

Advantageously, each winder comprises two turning vertical stops each located between two drive rollers in the same pair, designed to block the spool axially.

In the preferred form of the invention, each winder comprises a counterweight designed to exert a push on each spool toward drive rollers.

Said counterweight comprises, for example, an arm moving in vertical translation along a fixed post between an upper position, corresponding to a full spool, and a lower position, corresponding to an empty spool, as well as a means for automatically raising said arm; and said arm supporting at least two loose pulleys that are parallel to each other and to the spool and designed to contact the spool.

The arm may comprise four pulleys, two exterior loose pulleys designed to contact the spool when it is full and two interior loose pulleys designed to contact the spool when it is empty, and the means for raising the arm may comprise a dual-action cylinder controlled by an electrovalve.

Advantageously, the means for detecting the end of the strip on the working spool consists of at least one detector associated with said counterweight and designed to detect the arm position that corresponds to the minimum working spool diameter which would permit connection of the end of the strip on said spool to the beginning of the strip on the reserve spool.

The means for detecting the end of the strip on the working spool is designed to send one signal to the winder drive means corresponding to the reserve spool, signaling the reserve spool to rotate. The beginning of the strip on this spool has a visual indicator and a cold glue mesh extending over its entire width.

Preferably, the splicing means comprises a presence detector designed to detect the visual indicator located on the rotating reserve spool, said presence detector being designed to send a simultaneous signal to the trolley drive means and to the plate drive means to displace the trolley towards the reserve spool and to move said diversion rollers from the first connection position to the second, and conversely, depending upon which spool is the working spool.

In the preferred embodiment, the automatic splicing means comprises at least one cutting blade generally extending over the entire width of the spools, located essentially below said trolley and movable in vertical translation between a lower waiting position and an upper working position where it cuts the end of the strip on the working spool.

In addition, the device according to the invention advantageously comprises a means for automatically loading and unloading the spools which removes the empty spools and replaces them with full ones.

In accordance with the preferred embodiment, each winder comprises between its two platforms a plate which can move in vertical translation between a lower waiting position and an upper working position, said plate comprising a track consisting of several motorized rollers that are parallel to each other and perpendicular to the spool axis, said rollers being rotated by a motorized device and designed to support and axially displace said spool when the plate is raised in order to position it in the winder if it is a full spool, or to remove it from the winder if it is an empty one.

The plate may have at least two vertical dual-action cylinders to displace it from the lower position to the upper position, and conversely, and the motorized device may comprise at least one motor and one chain and pinion transmission or gear and pulley transmission to simultaneously drive said rollers.

BRIEF DESCRIPTION OF THE DRAWINGS

The features of the present invention will be better understood from the following description of one embodiment, provided as a non-limiting example, and with reference to the attached drawings, wherein:

FIG. 1 shows a schematic overhead view of the device of the invention;

FIG. 5 and associated FIGS. 5A, 5B, 5C, 5D and 5E are schematic views of the device of the invention showing the splicing means in various operational positions in a first direction of operation; and FIG. 6 and associated FIGS. 6E, 6F, 6G, 6H, and 6A are schematic views similar to the preceding views for a second direction of operation.

DETAILED DESCRIPTION OF THE INVENTION

Figure 2:
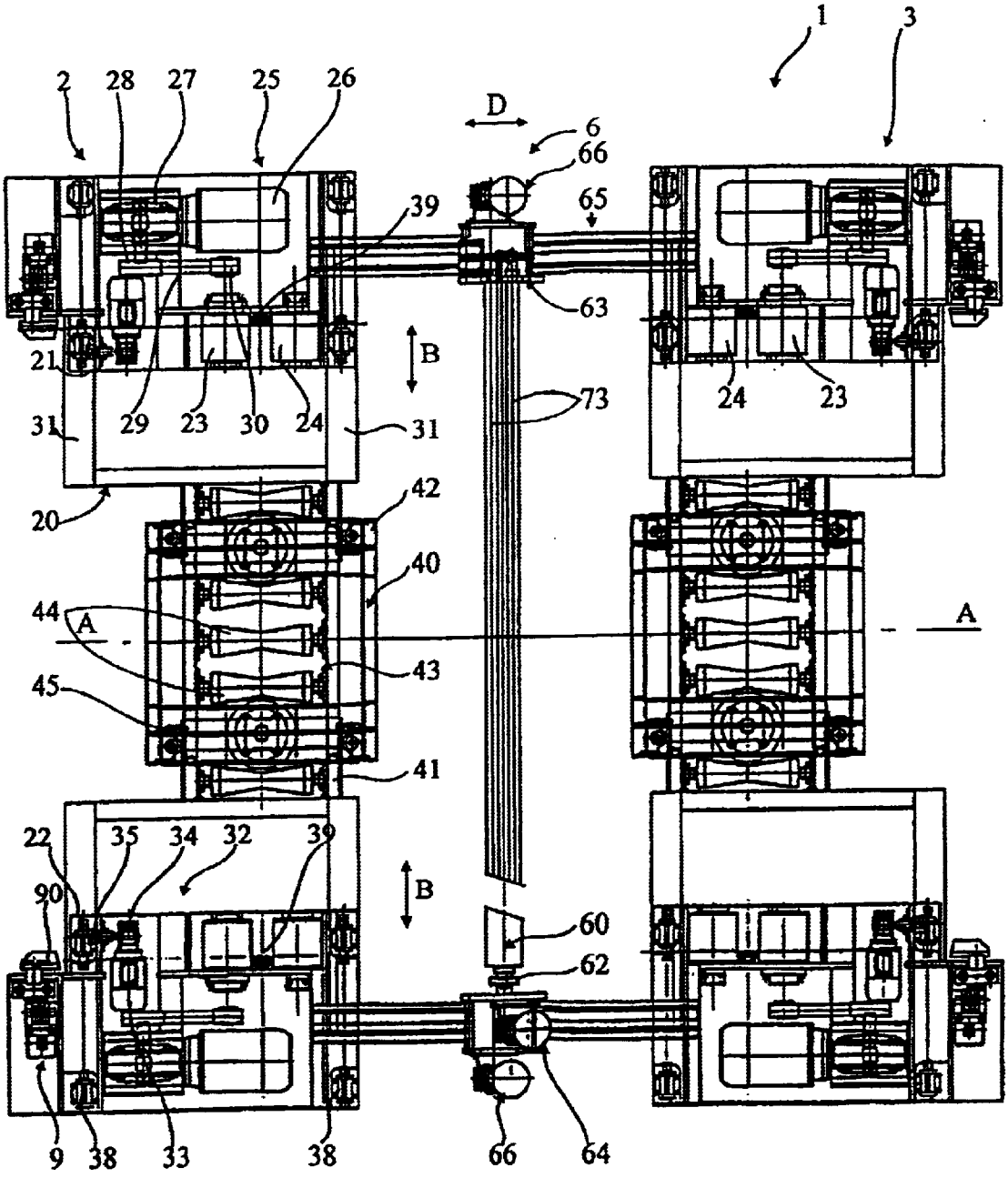
FIG. 2 is an overhead view of the device of the invention.

With reference to the drawings, the paper supply device 1, designed specifically to supply a cardboard manufacturing production line, comprises two winders 2, 3 parallel to each other and one behind the other, each designed to hold and unwind a spool of paper 4, 5, the first spool 4 being the working spool and the second spool 5 being the reserve spool, or vice versa. It also comprises a means 6 for automatically splicing the end of the working spool to the beginning of the reserve spool, ensuring a continuous supply to the production line. Said splicing means 6 is located between the two winders 2, 3 and parallel to them. The paper supply device 1 further comprises a means for automatically loading and unloading spools 7, 8, 40 to remove the empty spools and replace them with full ones. FIGS. 1 and 5 show reserve spools 4', 5' for replacing spools 4, 5 on winders 2, 3.

Winders 2, 3 are identical. Consequently, the references for the component parts will be the same for both winders. Winders 2, 3 each comprise a chassis 20 attached to the floor, two platforms 21, 22 attached to said chassis and moving in translation in the direction of arrows B symmetrically in relation to the median axis A of said device, said median axis being perpendicular to the axis of the spools. Each platform 21,22 comprises a pair of drive rollers 23, 24 that are parallel to the axis of the spool of paper and cause the spool to rotate on its axis. These rollers are preferably Pneuride® rollers but they may be replaced by other equivalent rollers. Rollers 23, 24 of the two platforms of a single winder are aligned and they support and drive the spool of paper at its extremities. Winders 2, 3 each comprise drive means 25 which consists, in the embodiment shown, of a motor 26, a shaft 27 supporting a motorized pulley 28 which uses a gear 29 to drive a receptor pulley 30 connected to one of the drive rollers 23. Obviously, other equivalent drive means could also be used. It is only necessary to make one drive roller 23 rotate, as the second roller 24 is automatically driven by the rotating spool of paper.

Chassis 20 consists of I-shaped sections 31 which are parallel to each other and to the spool axis and supporting an inverted T-shaped rail 31' which guides platforms 21, 22 in translation in order to adjust the interval between the two pairs of drive rollers to the width of the paper on the spool. For this purpose, a drive means 32 is provided on said winder, consisting of a stepping motor 33 coupled with a shaft 34 driving a pinion 35 which engages a rack 36 that is solidly attached below the upper branch of section 31. Each section 31 may comprise such a rack 36. In this case, corresponding pinions 35 are interconnected by a transmission shaft 37. Each platform 21, 22 is additionally equipped with slides 38, four in number, engaging rails 31' and sliding freely. Winders 2, 3 also each comprise two turning vertical stops 39, each located between two drive rollers 23, 24 in a single pair and designed to axially block said spool of paper. They may consist, for example of loose pulleys attached to ball bearings.

Figure 3:
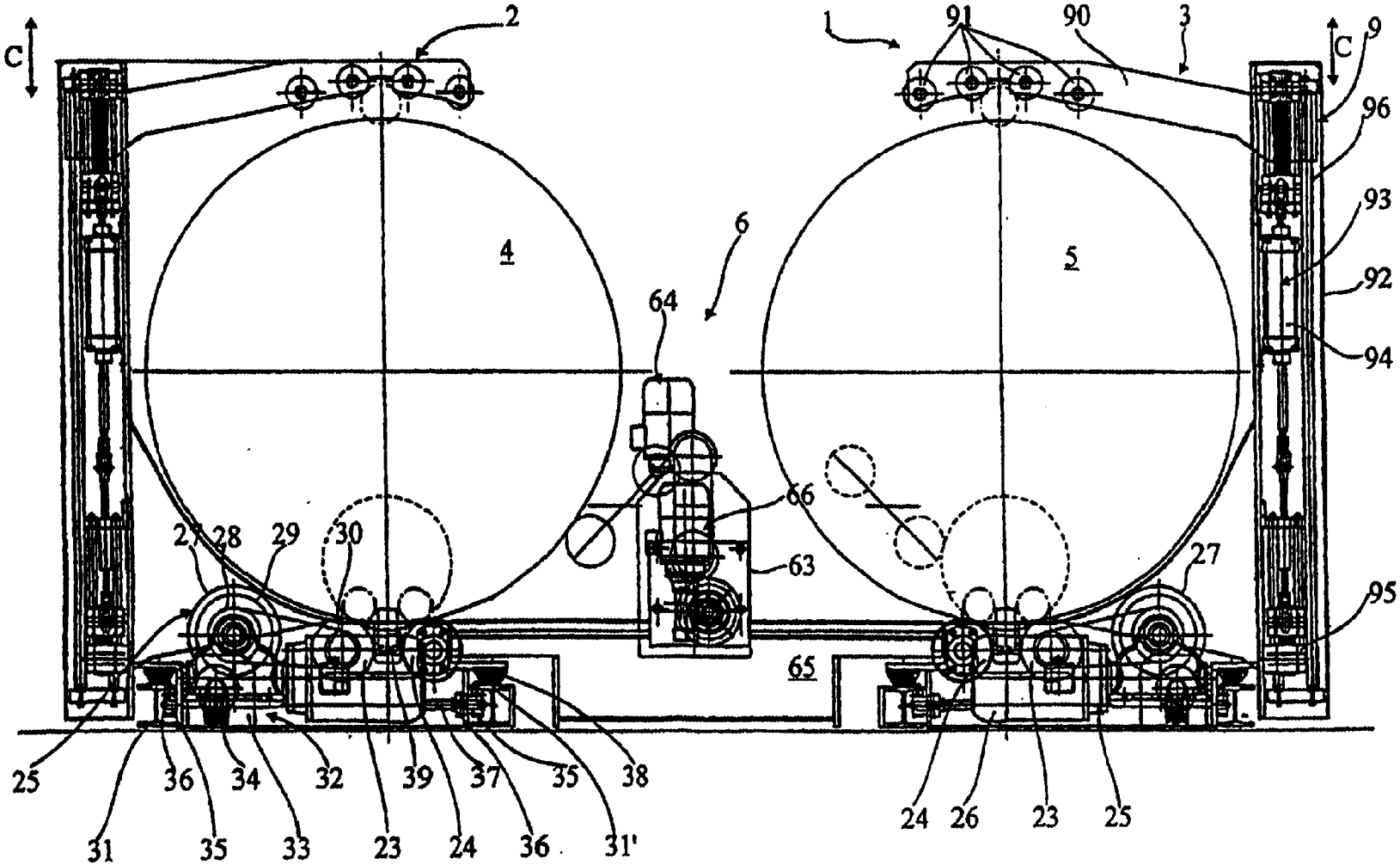
FIG. 3 is a front view of the device of the invention.
Figures 4A, 4B, 4C, 4D, 4E:
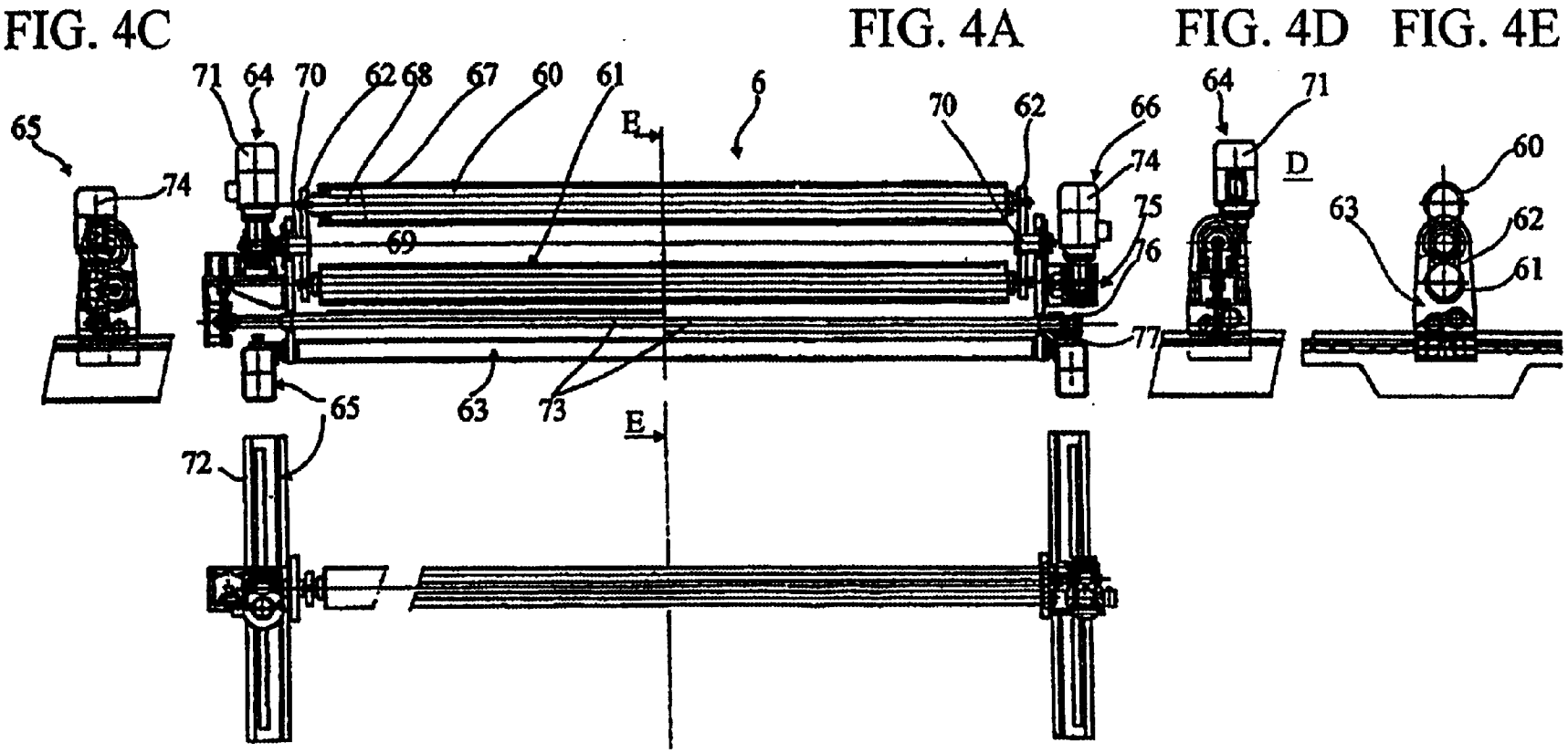
FIGS. 4A through 4E are respectively, a front view, an overhead view, a left view, a right view, and inside dashed line E—E, the splicing means of the device of the invention.

Winders 2, 3 are also each equipped with a counterweight 9 having an arm 90 supporting loose pulleys 91 which are parallel to each other and to the axis of the spool of paper, and contact the latter to exert a push on the corresponding spool toward its drive rollers 23, 24. Said arm 90 moves in vertical translation according to arrows C along a fixed post 92 between an upper position when the spool is full, and a lower position when the spool is empty. It moves from top to bottom and conversely, guided by slides 96 which are integral with fixed post 92. Pulleys 91 rotate freely on fixed axles and ball bearings, pins, or other equivalent devices. Four pulleys contact the spool two by two, with the exterior pulleys contacting the spool when it is full and the inside pulleys contacting the spool when it is empty. In FIG. 3, spools 4, 5 are shown in different stages of the unwinding process: the bold lines show the full spools, which may reach a maximum diameter of 1700 mm.; the dashed lines show nearly empty spools, with a diameter limited to about 400 mm., allowing them to be connected to the reserve spool; the shorter dashed lines show empty spools, that is, with only the spool itself remaining which may be 120 mm. in diameter. The spool is shown between drive rollers 23, 24 of the winder, as well as between pulleys 91 of the counterweight to show the minimum admissible diameters and the corresponding contact areas. Counterweight 9 also comprises a means 93 for automatically lifting arm 90 with a dual-action pneumatic cylinder 94 exerting counter pressure and controlled by electrovalve 95. There are devices provided at the end of the path (not shown) to detect the raised and lowered positions of arm 90 and send corresponding signals to a control unit (not shown) with a robot which can control the entire operation of device 1. When the spool connection has been completed, arm 90 of the empty spool is raised and the other arm is automatically lowered under the control of the robot.

Further with reference to FIGS. 4A through 4E, the automatic splicing means also comprises two diversion rollers 60, 61 parallel to each other and to the axes of spools 4, 5, said diversion rollers being separated by a predetermined fixed interval extending across the entire span of the spools and together receiving the strip of paper from the working spool. These diversion rollers 60, 61 may be made of steel, rubber, polyurethane, or any other suitable material. They rotate freely on a common plate 62, which rotates on a fixed axle of trolley 63, driven by plate drive means 64 so as to alternately place said diversion rollers 60, 61 in a first connected position and in a second connected position according to which spool is the working spool. As for trolley 63, it is attached to a chassis 65 affixed to the floor and moves in translation along said chassis in the direction of arrows D perpendicular to the axis of the spools, driven by trolley drive means 66.

Diversion rollers 60, 61 each consist of a hollow tube 67 attached to a traversing axle 68 by means of two ball bearings 69 provided at the ends of the tube. Traversing axles 68 are solidly attached at their extremities to two plates 62, each comprising a central shaft 70 rotating in a corresponding wall of trolley 63. At least one central shaft 70 is attached either directly or by a reducing gear or other mechanical transmitter to an output shaft of a motor 71 constituting the drive means 64 for the plate for modifying the angular position of diversion rollers 60, 61 as explained below.

Chassis 65 comprises two parallel rails 72, perpendicular to the axes of the spools and separated by an interval which at least equals the span of the spools, and trolley 63 comprises at least one motorized beam 73 extending between the two rails 72 and a drive means 66 consisting of a motor-reduction gear 74 controlling a drive gear 75, the last pinion 76 of which engages a rack 77 integral with rail 72 in order to displace said trolley along chassis 65. Preferably, trolley 63 comprises two motor-reduction gears 74 on either side, driven synchronously to ensure perfectly parallel translational displacement.

The splicing means 6 also comprises a serrated cutting blade 11, shown schematically in FIGS. 5 and 6, extending generally across the entire width of the spools, located below trolley 63 and moving in vertical translation between a lower waiting position and an upper working position where it sections the end of the strip on the working spool after connection. For this purpose, cutting blade 11 may be associated with a dual-action cylinder, a rack and pinion system, a cam system, or any other system suitable for displacing it vertically from bottom to top and conversely.

The splicing means is specially designed to automatically connect the end of the strip on the working spool with the beginning of the strip on the reserve spool at high speed, without any operator intervention. It is only necessary to prepare the fully loaded reserve spools by applying a cold glue mesh adhesive strip to the beginning of the strip and all along the width of the strip parallel to the spool axis and to position a visual marker indicating the location of the cold glue strip.

Next, the operation of the automatic splicing device 6 will be described with particular reference to FIGS. 5 and 6 and the associated schemas showing the position of diversion rollers 60, 61 in different operational phases depending upon whether the working spool is spool 4 or spool 5.

In FIG. 5, the working spool corresponds to spool 4. Winder 2 makes this spool rotate at a particular speed such that the speed at which the strip of paper unrolls corresponds to the speed demanded downstream on the production line. This speed may reach up to 1000 m/mn. Trolley 63 on the splicing means occupies a central position between the two winders 2, 3 and the diversion rolls 60, 61 of assembly means 6 are superimposed in the position shown in schema D of FIG. 5. Roller 60 is above roller 61, the latter being lightly shaded in the drawings to assist comprehension. The strip of paper of said working spool 4 moves along between the two diversion rollers 60, 61 according to the arrows towards another diversion roller 10 located above to guide and shift the strip of paper toward the downstream portion of the production line (not shown). When working spool 4 reaches the minimum diameter permitting connection to reserve spool 5, as shown by dashed lines in FIG. 5, plate 62 turns slightly in a counterclockwise direction to place rollers 60, 61 in the position shown by schema E in FIG. 5, called the first connecting position. Trolley 63 moves toward reserve spool 5 to place roller 61 near spool 5 within nearly 1 cm. of its surface, and winder 3 is placed in operation to rotate reserve spool 5 at the same speed as working spool 4. Reserve spool 5 has on its periphery a visual indicator and a cold glue mesh forming an adhesive strip across its entire width. When the visual index is detected by splicing means 6, trolley 63 moves close to spool 5 to place roller 61, encircled by the end of the strip from working spool 4, in contact with the beginning of the strip on reserve spool 5. At that instant the two strips of paper adhere to each other and the end of one strip pulls the beginning of the other strip toward the production line. Simultaneously, cutting blade 11 of splicing means 6 is activated and sections the end of the strip on spool 4. This spool can be automatically removed and replaced by spool 4' which becomes new reserve spool 4.

Reference is made to schema E of FIG. 6. Next, trolley 63 returns to its central position and plate 62 turns in a clockwise direction to place rollers 60, 61 in the position shown in schema H in which the two rollers are again superimposed, but roller 61 is above roller 60. When working spool 5 reaches the minimum diameter for connection to reserve spool 4, as shown by dashed lines in FIG. 6, plate 62 turns slightly in a clockwise direction to place rollers 60, 61 in the position shown by schema A of FIG. 6, called the second connecting position, trolley 63 is displaced toward reserve spool 4 to place roller 60 nearly 1 cm. away from the surface of reserve spool 4, and winder 2 is activated to rotate reserve spool 4 at the same speed is working spool 5. Reserve spool 4 has a visual indicator on the periphery and a web of cold glue forming an adhesive strip across its entire width. When the visual indicator is detected by assembly means 6, trolley 63 moves close to spool 4 to place roller 60, encircled by the end of the strip from working spool 5, in contact with the beginning of the strip on reserve spool 4. At that instant the two strips of paper adhere to each other and the end of one strip pulls the beginning of the other strip toward the production line. Simultaneously, cutting blade 11 of splicing means 6 is activated and sections the end of the strip on spool 5. This spool can be automatically removed and replaced by spool 5' which becomes new reserve spool 5.

Reference is made to schema A of FIG. 5. Next, trolley 63 returns to its central position and plate 62 turns counterclockwise to place rollers 60, 61 in the position shown by schema D, with the two rollers again superimposed, roller 60 being above roller 61. These cycles can be repeated as many times as necessary.

To place diversion rollers 60,61 in the different positions going from the first connection position (schema E) to the second connection position (schema A), plate 62 alternately rotates less than one complete turn, said rotation being limited to 270°, for example. This original concept prevents the strip of paper from ever being lost as it moves between the two rollers 60, 61 and alternately connects one spool to the other in a continuous manner, without any interruption or manipulation. Furthermore, splicing means 6 comprises a presence detector (not shown) which detects the visual index located on the full reserve spool and simultaneously sends a signal to the drive means 66 for trolley 63 and to drive means 64 for plate 62 to direct movement of the trolley toward the reserve spool and to place diversion rollers 60, 61 in one or the other connection positions.

The paper supply device according to the invention also comprises a means for automatically loading and unloading spools 7, 8, 40, removing the empty spools and replacing them with full spools. The loading and unloading means 7, 8 outside unwinding devices 2, 3 are not detailed in the present application. They are simply shown schematically as motorized trolleys 7, 8 which position reserve spools 4', 5' or remove empty spools 4, 5 (see FIGS. 1 and 5). For this reason, trolleys 7, 8 are displaced along rails attached to the floor, filoguided, radio controlled, or driven and controlled by any other equivalent means.

In addition, each winder 2, 3 comprises an internal means for automatically loading and unloading spools 40. Said means 40 comprises a plate 41 positioned between two platforms 21, 22 on a specific chassis 42 located between sections 31 of interrupted chassis 20. Platform 41 comprises a pathway 43 consisting of several motorized rollers 44 which are parallel to each other with inwardly curved central portions. This pathway 43 is located below and inside the axle of the corresponding spool of paper. Rollers 44 are rotated simultaneously by a motor and a chain and pinion or a gear and pulley device (not shown). In addition, platform 41 is movable in vertical translation between a lower, waiting position in which path 43 does not contact the spool of paper, which is resting on its drive rollers 23, 24, and an upper working position in which path 43 contacts said spool, which has been raised above its drive rollers 23, 24. For this purpose, two dual action pneumatic cylinders 45 or some other similar means are provided beneath platform 41 to generate a vertical course of about 50–60 mm.

Consequently, to remove an empty spool or load a full spool onto a winder 2, 3, platform 41 is placed in the upper position and its path 43 is activated in one direction or the other in order to axially displace the corresponding spool towards either the exterior or the interior of the winder, according to the situation. Preferably, and when there is enough space available, the full spools are loaded using a trolley on one side of the winding devices and the empty spools are unloaded using another trolley on the other side of the winding devices, while remaining within the axes of said spools. When there is not enough space, the empty spools are recovered using the same trolley that transports the full spools, and then returned to storage. With two directional trolleys for each roller, the spools can be changed in less than 20 seconds.

Paper supply device 1 of the invention also comprises a control unit (not shown) which may consist of a central processing unit located at a control desk equipped with a robot which controls the various drive means according to the operational stage of the various sub-assemblies and associated detectors. It has been mentioned previously that the spool to be joined is rotated one time before it is spliced in order to match its speed to that of the spool being finished; this is done using a variable change speed gear and an electronic system. Control parameters can also be integrated, such as weight, grams, quality, number of meters, spool width, etc. Specifically, there are weighing mechanisms attached to platform 41 for measuring the weight of the full spool, the weight used, and the weight remaining on the spool after splicing. This permits calculation of the number of meters on the strip of paper that have been used as well as the number of meters remaining to the nearest meter. Thus, it is possible to program the number of meters used before splicing is required, which essentially corresponds to a minimum diameter of 400 mm. In this case, once that number is reached, the robot activates trolley 63 of automatic assembly means 6 and activates all the associated operations.

It is apparent from the foregoing description that the invention achieves all its objectives. In particular, the paper supply device 1 is a relatively simple, compact and economical machine with totally automatic operation, primarily due to the automatic splicing means 6 and winding devices 2, 3 with automatic loading and unloading means allowing the strip of paper to move at high speed and the spools to be connected at this speed, and reducing manual intervention to a minimum.

The invention has been described in the unwinding mode for continuously supplying a production line. Another feature of the present invention is that it can wind as well as unwind. Because of this, it can also be used as a winding machine, particularly for preparing full spools from the leftovers on nearly empty spools. To avoid frequent use of spools with a diameter of less than 400 mm, they are loaded on the supply device where a spool is unwound on an unwinding device and another spool is rolled on the other unwinding device used as a winding machine, connecting the spools to create one spool of normal diameter. In this case, both rotation speed and the automatic splicing means are controlled manually to complete the connection.

The present invention is not limited to the embodiment described, but extends to any modification or variation obvious to one skilled in the art while still remaining within the scope of the protection conferred in the attached claims. Likewise, the application of the invention is not limited to spools of paper and a cardboard manufacturing production line, but extends to any other equivalent application for fabric, non-woven material, and any other material in a strip on a spool.

What is claimed is:

1. A paper supply device (1) for supplying paper for a cardboard manufacturing production line, the paper supply device comprising:

a working spool having a longitudinal axis and a first spool of paper on the working spool, the first spool of paper having a first end;

a reserve spool having a longitudinal axis and a second spool of paper on the reserve spool, the second spool of paper having a second end;

a first and second winder (2, 3) spaced from one another and parallel to each other; the first and second winder (2,3) each supports one of the working spool and the reserve spool;

a drive mechanism to alternately activate the first and second winder to ensure a continuous supply of paper to the production line;

a sensor for detecting the first end of the first spool of paper on the working spool;

an automatic splicing device (6) for automatically joining the first end of the first spool of paper with the second end of the second spool of paper;

a trolley (63) having a trolley motor (66) to allow the trolley to move in a direction perpendicular to the longitudinal axis of the working spool and the reserve spool;

at least one common plate (62) that is supported by the trolley and the at least one common plate having a fixed axle and a plate motor (64), the plate motor allowing the at least one common plate to rotate about the fixed axle;

two diversion rollers (60, 61) each having a central axle and the two diversion rollers are connected to the at least one common plate to shift between a first and second connecting position, the two diversion rollers are separated by a predetermined fixed distance;

wherein the two diversion rollers extend at least across an entire width of one of the working spool and the receiving spool, the diversion rollers are designed to jointly receive one of the first spool of paper and the second spool of paper, the two diversion rollers rotate freely about the at least one common plate (62) and are driven to rotate on each respective central axles by one of the first spool of paper and the second spool of paper as it unrolls; the trolley (63) moves to position one of the two diversion rollers to contact with one of the working spool and the reserve spool while in one of the first and second connecting position;

the automatic splicing device (6) further comprises at least two parallel rails (72) attached to a floor and substantially perpendicular to the longitudinal axis of the working spool and the reserve spool, the at least two rails are separated by a distance at least equal to the width of the paper on the working spool and the reserve spool, the at least two parallel rails are equipped with a -rack (77)-, and the trolley (63) further comprises at least one motorized beam (73) having first and second ends, the motorized beam extending between the at least two parallel rails and having a pinion (76) at the first and second ends which engages the rack (77) of the corresponding rails (72), the trolley motor (66) for driving the trolley (63) comprises at least one motor (74) and a mechanical transmission (75) coupled to the motorized beam (73).

2. A paper supply device (1) for supplying paper for a cardboard manufacturing production line, the paper supply device comprising:

a working spool having a longitudinal axis and a first spool of paper on the working spool, the first spool of paper having a first end;

a reserve spool having a longitudinal axis and a second spool of paper on the reserve spool, the second spool of paper having a second end;

a first and second winder (2, 3) spaced from one another and parallel to each other; the first and second winder (2,3) each supports one of the working spool and the reserve spool;

a drive mechanism to alternately activate the first and second winder to ensure a continuous supply of paper to the production line;

a sensor for detecting the first end of the first spool of paper on the working spool;

an automatic splicing device (6) for automatically joining the first end of the first spool of paper with the second end of the second spool of paper;

a trolley (63) having a trolley motor (66) to allow the trolley to move in a direction perpendicular to the longitudinal axis of the working spool and the reserve spool;

at least one common plate (62) that is supported by the trolley and the at least one common plate having a fixed axle and a plate motor (64), the plate motor allowing the at least one common plate to rotate about the fixed axle;

two diversion rollers (60, 61) each having a central axle and the two diversion rollers are connected to the at least one common plate to shift between a first and second connecting position, the two diversion rollers are separated by a predetermined fixed distance;

wherein the two diversion rollers extend at least across an entire width of one of the working spool and the receiving spool, the diversion rollers are designed to jointly receive one of the first spool of paper and the second spool of paper, the two diversion rollers rotate freely about the at least one common plate (62) and are driven to rotate on each respective central axles by one of the first spool of paper and the second spool of paper as it unrolls; the trolley (63) moves to position one of the two diversion rollers to contact with one of the working spool and the reserve spool while in one of the first and second connecting position;

each of the first and second winders (2, 3) has at least one chassis (20) attached to a floor, at least one platform (21, 22) attached to the chassis and two pair of drive rollers (23, 24) parallel to at least one of the longitudinal axis of the working and reserve spools, the two pair of drive rollers (23, 24) are aligned and support one of the first and second spools of paper, the drive mechanism (25) for driving the winder comprises a motor (26), a motor shaft and a mechanical transmission (27–30) for driving at least one drive roller (23) of at least one of the two pair of drive rollers.

3. The paper supply device according to claim 2, wherein each of the first and second winders (2, 3) comprise first and second platforms (21, 22) that respectively supports a pair of drive rollers (23, 24), the first and second platforms are movable in a direction symmetrically to a median axis (A) of the paper supply device, the median axis is perpendicular to both the longitudinal axis of the working and reserve spools so as to adjust a distance between the pair of drive rollers on the first and second platforms to a width of paper of at least one of the first and second spools of paper.

4. The paper supply device according to claim 3, wherein the at least one chassis (20) of the first and second winders (2, 3) comprises two sections (31) that are parallel to each other and to the longitudinal axis of the working spool and the reserve spools, at least one section supports a rack (36), and the first and second platforms (21, 22) each has at least two slides (38) which slide along the two sections and at least one step motor (33) drives a pinion (35) which engages the rack (36).

5. The paper supply device according to claim 3, wherein each of the first and second winders (2, 3) further comprise two vertical turning stops (39) located between a single pair of drive rollers (23, 24) for axially blocking a spool of paper.

6. The paper supply device according to claim 2, wherein each of the first and second winders (2, 3) comprise a counterweight (9) designed to exert force on one of the first and second spools of paper against the pair of drive rollers (23, 24).

7. The paper supply device according to claim 6, wherein the counterweight (9) of each of the respective first and second winders comprises an arm (90) movable in a vertical direction along a fixed pole (92), the arm (90) moves between an upper position, when one of the working and reserve spools is full of paper, and a lower position, when the one of the working and reserve spools is empty of paper, as well as a lifting mechanism (93) for automatically raising the arm, the arm supporting at least two loose pulleys (91) that are parallel to each other and to the longitudinal axis of one of the working and reserve spools, the loose pulleys are designed to contact one of the working and reserve spools.

8. The paper supply device according to claim 7, wherein the arm (90) comprises four loose pulleys (91), two exterior loose pulleys designed to contact one of the working and reserve spools, when full of paper, and two interior loose pulleys designed to contact the one of the working and reserve spools when empty of paper.

9. The paper supply device according to claim 7, wherein the arm (90) has a lifting mechanism (93) for automatically lifting comprises a dual-action cylinder (94) controlled by an electrovalve (95).

10. The paper supply device according to claim 7, wherein the sensor for detecting the first end of the first spool of paper comprises at least one device for detecting the end of a course associated with the counterweight (9) and designed to detect the arm position corresponding to a minimum admissible diameter of the working spool that would allow the first end of the first spool of paper to be connected to the second end of the second spool of paper on the reserve spool.

11. The paper supply device according to claim 10, wherein the sensor for detecting the first end of the first spool of paper on the working spool is designed to send a signal to the drive mechanism (25) for the winder corresponding to the reserve spool for the drive mechanism (25) to rotate the reserve spool, as the second spool of paper carries a visual index and cold glue mesh extending over its entire width.

12. The paper supply device according to claim 11, wherein the automatic splicing device (6) comprises a presence detector designed to detect a visual indicator located on the reserve spool that is being rotated, the presence detector is designed to simultaneously send a signal to the trolley motor (66) and to the plate motor (64) to displace the trolley towards the reserve spool and to place the two diversion rollers from the first connecting position to the second connecting position, and conversely, depending upon which spool is currently dispensing paper.

13. The paper supply device according to claim 12, wherein the automatic splicing device (6) comprises at least one cutting blade (11) extending generally across the entire span of a spool of paper, located generally below the trolley (63) and movable in a vertical direction from a lower waiting position to an upper working position in which the at least one cutting blade (11) cuts the end of one of the working and reserve spools of paper.

14. The paper supply device according to claim 3, further comprises an automatic loader (7, 8, 40) for automatically unloading empty spools and automatically loads full spools.

15. The paper supply device according to claim 14, wherein each of the first and second winders (2, 3) respectively comprise, between first and second platforms (21, 22), a third platform (41) that is movable in a vertical direction from a lower waiting position to an upper working position, the third platform has a track (43) and a plurality of motorized rollers (44) parallel to each other and perpendicular to a spool axis, the plurality of motorized rollers are rotated by a roller motor and designed to support and axially displace the respective spool when the third platform is in the upper position so as to position the spool in one of first and second winders, if the spool is full or remove from one of first and second winders, if the spool is empty.

16. The paper supply device according to claim 15, wherein the third platform (41) comprises at least two vertical dual-action cylinders (45) designed to displace the third platform from the lower position to the upper position and vice versa.

17. The paper supply device according to claim 15, wherein the roller motor comprises at least one motor and one of a chain and pinion transmission, and a pulley and gear transmission for driving the motorized rollers simultaneously.

18. A paper supply device (1) for supplying paper for a cardboard manufacturing production line wherein, the paper supply device comprises;

a working spool having a longitudinal axis and a first spool of paper on the working spool, the first spool of paper having a first end;

a reserve spool having a longitudinal axis and a second spool of paper on the reserve spool, the second spool of paper having a second end;

first and second winders (2, 3) spaced from one another and parallel to each other; the first and second winders (2,3) each supports one of the working spool and the reserve spool;

a drive mechanism to alternately activate the first and second winders to ensure a continuous supply of paper to the production line;

a sensor for detecting the first end of the first spool of paper on the working spool;

an automatic splicing device (6) for automatically joining the first end of the first spool of paper with the second end of the second spool of paper;

a trolley (63) having a trolley motor (66) to allow the trolley to move in a direction perpendicular to the longitudinal axis of the working spool and the reserve spool;

at least one common plate (62) that is supported by the trolley and the at least one common plate having a fixed axle and a plate motor (64), the plate motor allowing the at least one common plate to rotate about the fixed axle;

two diversion rollers (60, 61) each having a central axle and the two diversion rollers are connected to the at least one common plate to shift between first and second connecting positions, the two diversion rollers are separated by a predetermined fixed distance;

the two diversion rollers extend at least across an entire width of one of the working spool and the receiving spool, the two diversion rollers are designed to jointly receive one of the first spool of paper and the second spool of paper, the two diversion rollers rotate freely about the at least one common plate (62) and are driven to rotate on each respective central axles by one of the first spool of paper and the second spool of paper as the second spool unrolls; the trolley (63) moves to position one of the two diversion rollers to contact with one of the working spool and the reserve spool while in one of the first and second connecting positions;

the plate motor (64) further comprises at least one motor (71), a motor shaft and a mechanical transmission located between the motor shaft and the at least one common plate (62), the plate motor being designed to alternately move a platform at an angle less than 360°, with the limits of this angle corresponding to the first and second connecting positions for the two diversion rollers and the angle ranges from 250° to 290°.

* * * * *

UNITED STATES PATENT AND TRADEMARK OFFICE

CERTIFICATE OF CORRECTION

PATENT NO. : 6,758,432 B1
DATED : July 6, 2004
INVENTOR(S) : Donato Rufo

It is certified that error appears in the above-identified patent and that said Letters Patent is hereby corrected as shown below:

Title page,
Item [76], Inventor, replace “Macbard” with -- Machard --

Signed and Sealed this

Seventh Day of September, 2004

JON W. DUDAS
*Director of the United States Patent and Trademark Office*